US010694824B2

(12) United States Patent
Bongers

(10) Patent No.: US 10,694,824 B2
(45) Date of Patent: Jun. 30, 2020

(54) HAT UMBRELLA

(71) Applicant: Ray Bongers, Atlanta, GA (US)

(72) Inventor: Ray Bongers, Atlanta, GA (US)

( * ) Notice: Subject to any disclaimer, the term of this patent is extended or adjusted under 35 U.S.C. 154(b) by 0 days.

(21) Appl. No.: 16/379,459

(22) Filed: Apr. 9, 2019

(65) Prior Publication Data

US 2019/0313750 A1 Oct. 17, 2019

Related U.S. Application Data

(60) Provisional application No. 62/658,920, filed on Apr. 17, 2018.

(51) Int. Cl.

| | |
|---|---|
| ***A45B 11/04*** | (2006.01) |
| ***A45B 25/02*** | (2006.01) |
| *A45B 11/00* | (2006.01) |
| *A42B 1/20* | (2006.01) |

(52) U.S. Cl.

CPC ..... *A45B 11/04* (2013.01); *A45B 25/02* (2013.01); *A42B 1/201* (2013.01); *A45B 2011/005* (2013.01)

(58) Field of Classification Search

CPC ..... A42B 11/04; A42B 1/201; A45B 25/02; A45B 11/04

See application file for complete search history.

(56) References Cited

U.S. PATENT DOCUMENTS

| | | | | | |
|---|---|---|---|---|---|
| 250,803 | A * | 12/1881 | Gray | A42B 1/201 | 2/171.03 |
| 1,532,310 | A * | 4/1925 | Funke | A42B 1/201 | 2/195.7 |
| 2,140,647 | A * | 12/1938 | Myers | A45B 11/04 | 135/19.5 |
| 2,227,554 | A * | 1/1941 | Riordon | A42B 1/201 | 135/19.5 |
| 2,743,455 | A * | 5/1956 | Langness | A42B 1/201 | 2/209.11 |
| 3,049,720 | A * | 8/1962 | Caine | A42B 1/201 | 2/171.03 |
| 3,374,488 | A * | 3/1968 | Erbb | A42B 1/201 | 2/171.02 |
| 4,131,954 | A * | 1/1979 | Brock | A42B 1/201 | 135/15.1 |
| 4,148,102 | A * | 4/1979 | Ying-Yu | A42B 1/206 | 135/96 |
| 4,326,301 | A * | 4/1982 | Brock | A45B 11/04 | 135/16 |
| 2013/0048038 | A1* | 2/2013 | Herrera | A45B 11/00 | 135/31 |

* cited by examiner

*Primary Examiner* — Tajash D Patel
(74) *Attorney, Agent, or Firm* — Wang Law Firm, Inc.

(57) ABSTRACT

A hat-umbrella comprises a circular frame with a shade attached to a plurality of extendable and retractable radial supports that form an umbrella around the circular frame. When expanded, the radial supports extend away from the circular frame, thus a large shade is formed. When retracted, the radial supports collapses around the circular frame and the shade is folded.

11 Claims, 6 Drawing Sheets

HAT UMBRELLA

RELATED APPLICATION

This application is the non-provisional application of the U.S. Provisional Patent Application for Hat Umbrella, 62/658,920, filed on Apr. 17, 2018, the specification of which is incorporated herein by this reference.

FIELD OF THE INVENTION

The invention relates to clothing apparel, and more particularly, to a hat with retractable umbrella.

BACKGROUND OF THE INVENTION

A hat in summer time serves many purpose; it provides cover to the sunshine on a hot day and it is also part of the apparel. To provide a good coverage from the sunshine generally it is needed a sizeable brim. An ordinary hat does not provide much protection against the rain because lack of sizeable brim and the brim is also easily damaged by the rain. A large brim can also serve as fashion statement. However, the large brim makes the storage of the hat difficult.

Therefore, it is desirable to have a hat with a large brim and yet the hat is easily stored, and it is to this hat the present invention is primarily directed to.

SUMMARY OF THE INVENTION

The present invention provides a hat umbrella that comprises an upper circular frame, a lower circular frame slidably mounted on the upper circular frame, and a plurality of radial supports. Each radial support has a plurality of ribs with a first rib movably attached to the lower circular frame and a second rib movably attached to the upper circular frame. When the first rib and the second rib of a radial support move away from each other, the radial support retracts toward the upper circular frame, and when the first rib and the second rib of the radial support move toward each other, the radial support expand away from the upper circular frame.

The hat umbrella further comprises a connecting pin movably securing the first rib and the second rib of a radial support and each rib is curved toward the upper circular frame. A removable shade can be attached to the plurality of radial supports and the removable shade has a plurality of precut folds. The hat umbrella may be mounted on a helmet with a head piece. The hat umbrella has a plurality of swingable hinges, wherein each rib of each radial support is attached to either the upper circular frame or the lower circular frame through a swingable hinge. A handle may be attached to the lower circular frame for rotating the lower circular frame relative to the upper circular frame and two ribs of a radial support form an isosceles triangle. The rotating mechanism is provided by a circular bearing, wherein the upper circular frame is placed on top of the circular bearing and the lower circular frame is placed under the circular bearing.

In yet another embodiment of the invention there is also provided a method for protecting from sunshine or rain using a hat umbrella with retractable shade, the hat umbrella having a upper circular frame, a lower circular frame, and a plurality of radial supports, each radial support having two ribs, each rib is attached to either the upper circular frame or the lower circular frame. The method comprises moving two ribs of each radial support away from each other, extending a shade attached to the radial support on the hat umbrella, moving two ribs of each radial support toward each other, and collapsing the shade according to a precut folds.

BRIEF DESCRIPTION OF THE DRAWINGS

Features and advantages of embodiments of the invention will become apparent as the following Detailed Description proceeds, and upon reference to the Drawings, where like numerals depict like elements, and in which.

and

Figure 10:
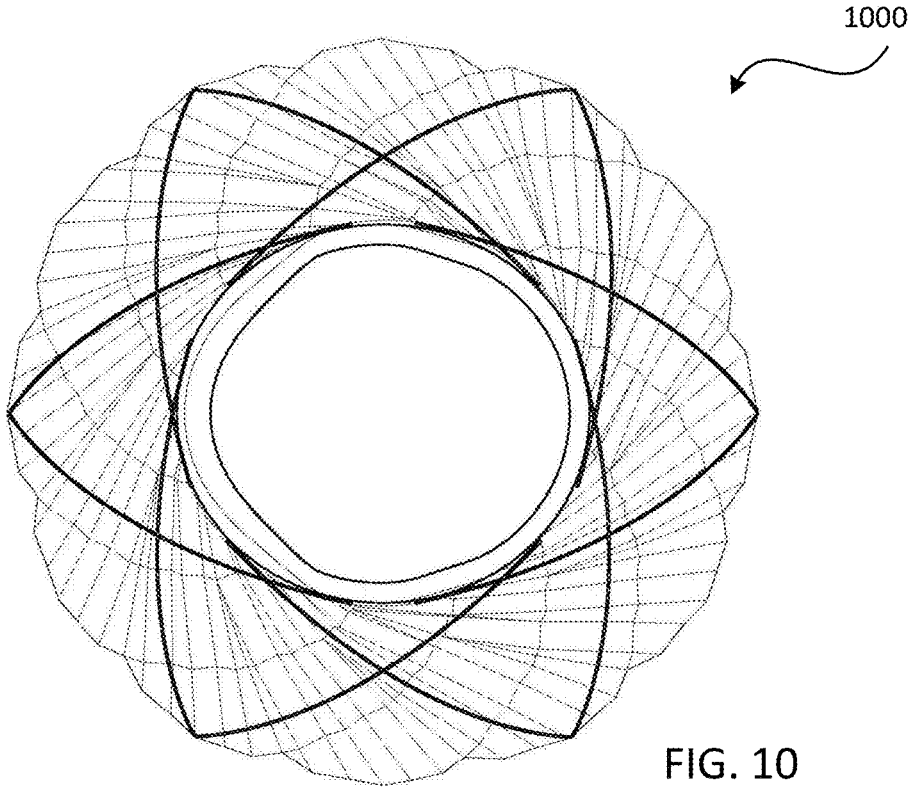
FIG. 10 is an illustration 1000 showing the radial supports under the cover.
Figure 11:
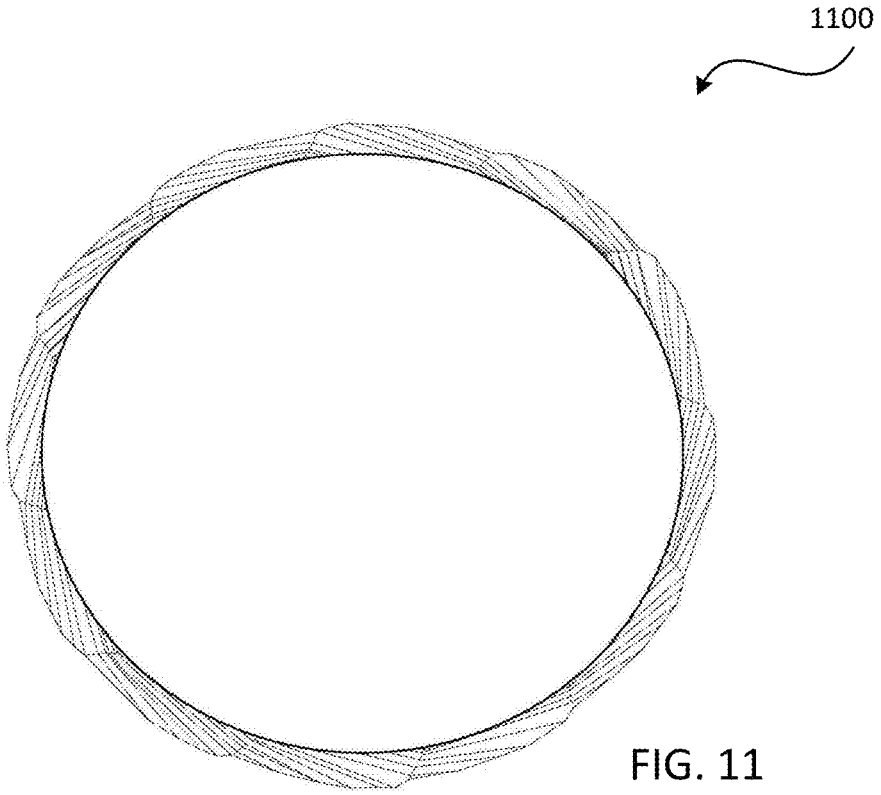

FIG. 11 is an illustration 1100 showing the cover of FIG. 10 in a collapse state.

DETAILED DESCRIPTION OF THE INVENTION

Figure 1:
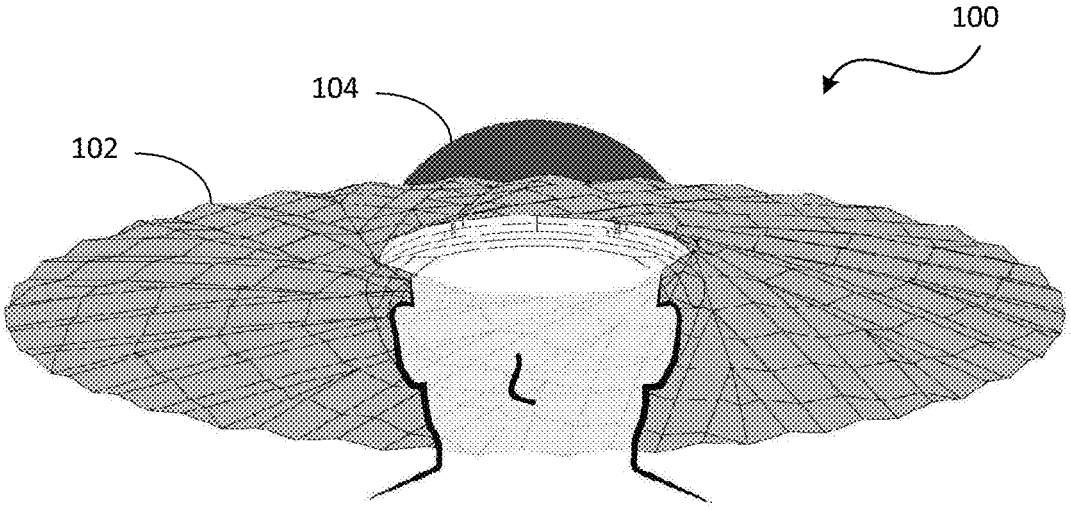
FIG. 1 is an illustration 100 of a hat umbrella according to one embodiment of the invention worn by a person.
Figure 2:
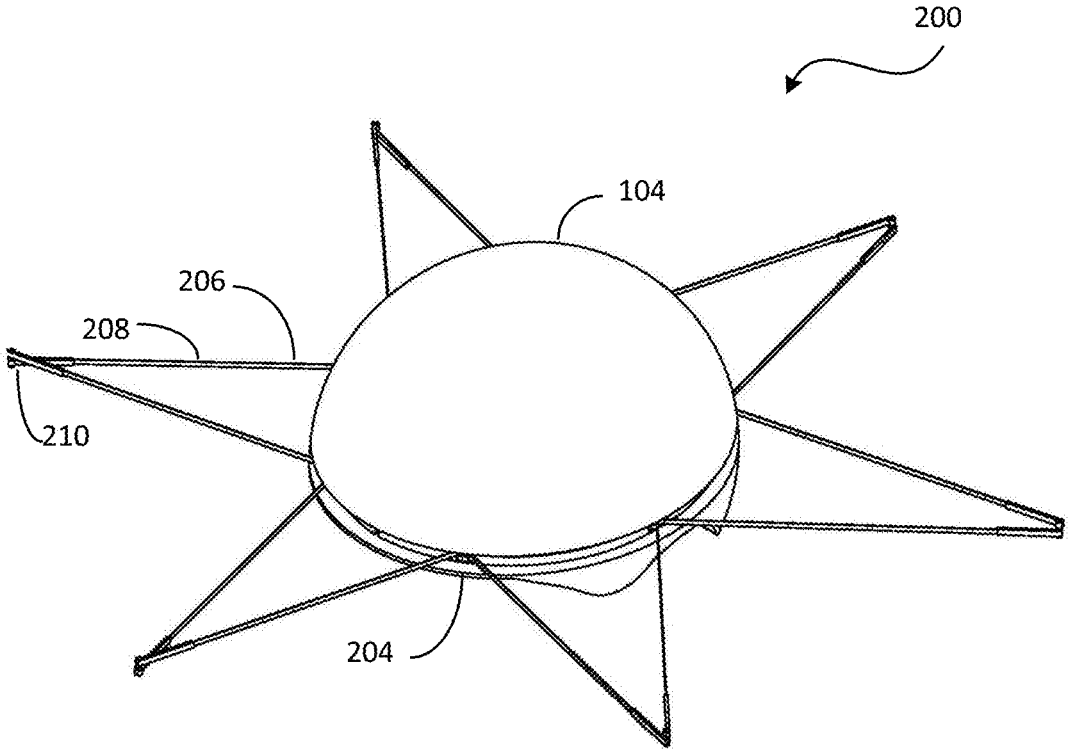
FIG. 2 is an illustration 200 of a mechanism of the hat umbrella.

In this description, shade and brim are used interchangeably. The present invention provides a hat with a large and yet retractable shade. This hat umbrella provides protection against the sunshine or rain through the large brim and yet can be stored without occupying a large area. The brim (or shade) can be retracted around the hat and easily expanded through a simple mechanism. FIG. 1 illustrates one embodiment 100 of the hat umbrella expanded and placed on a user. The hat umbrella 100 is basically a shade 102 attached to a head piece 104 and mounted on a frame. FIG. 2 is a frame 200. The frame 200 includes a head piece 104 mounted on a circular frame 204 and around this circular frame 204 many radial supports 206 are mounted. Each radial support 206 is made from two ribs 208 attached to the circular frame 204 and connected through a connecting pin 210. The head piece 104, though shown as circular, is optional and may also have different shapes.

Figure 3:
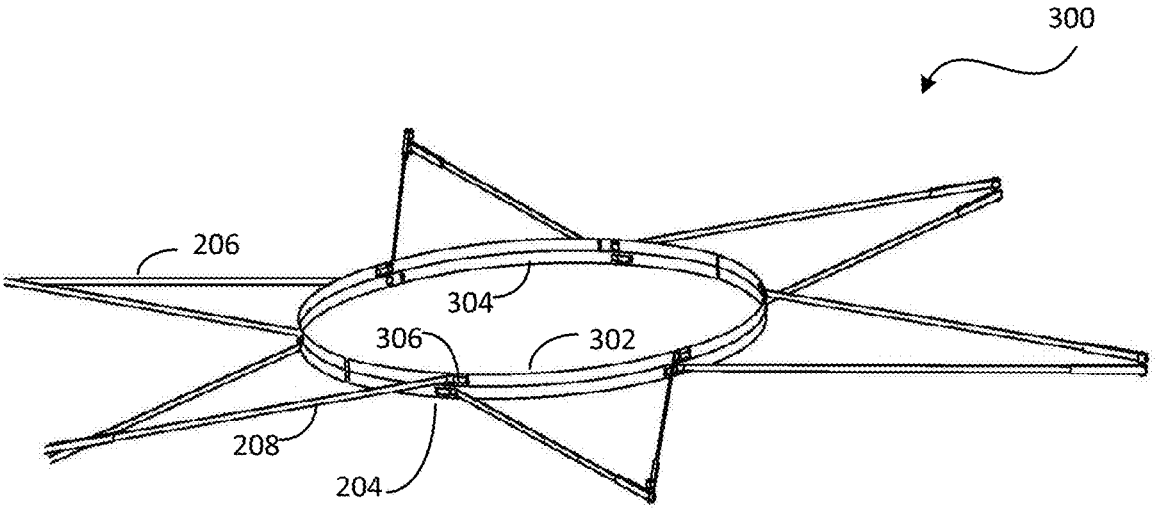
FIG. 3 is an illustration 300 of the basic expanding mechanism of the hat umbrella.
Figure 4:
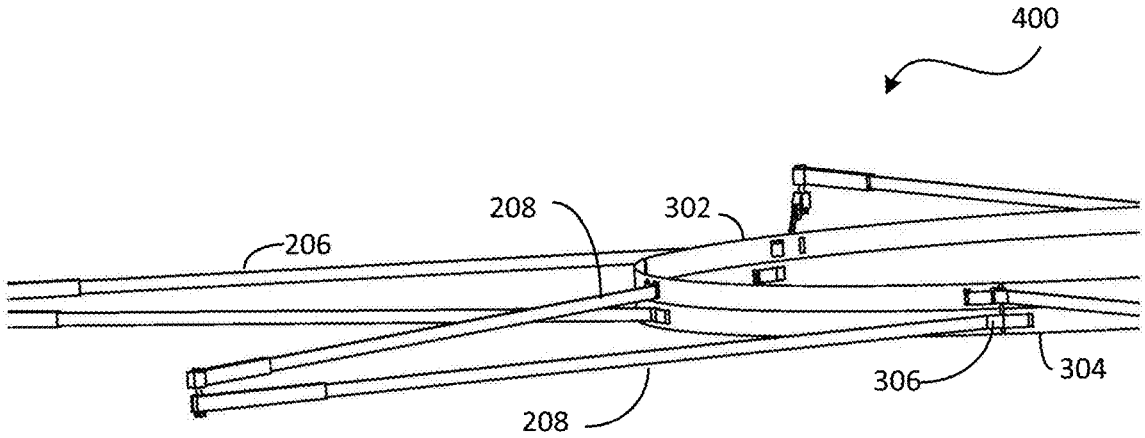
FIG. 4 is a detail illustration 400 of the expanding mechanism.

FIG. 3 is an illustration 300 of the frame 200 without the head piece 104. The circular frame 204 has an upper circular frame 302 and a lower circular frame 304. The upper circular frame 302 and the lower circular frame 304 are independent and can rotate to opposite directions. Each radial support 206 is made from two ribs connected through a connecting pin 210 One rib 208 of the radial support 206 is attached to a swingable hinge 306 on the upper circular frame 302 while the other rib 208 of the same radial support 206 is attached to another swingable hinge 306 on the lower circular frame 304. When the upper circular frame 302 rotates in the opposite direction relative to the rotation of the lower circular frame 304, the radial support 206 is retracted. FIG. 4 is another illustration 400 depicting the radial support 206 connection to the upper circular frame 302 and the lower circular frame 304 in more detail.

Figure 5:
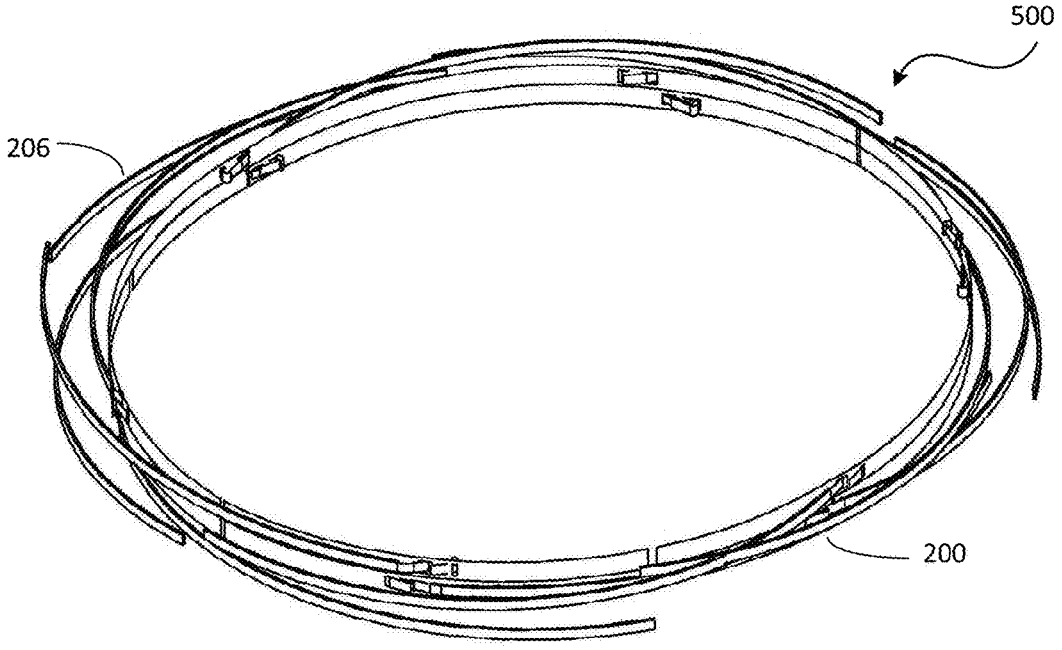
FIG. 5 is an illustration 500 showing the mechanism in a collapse state.
Figure 6:
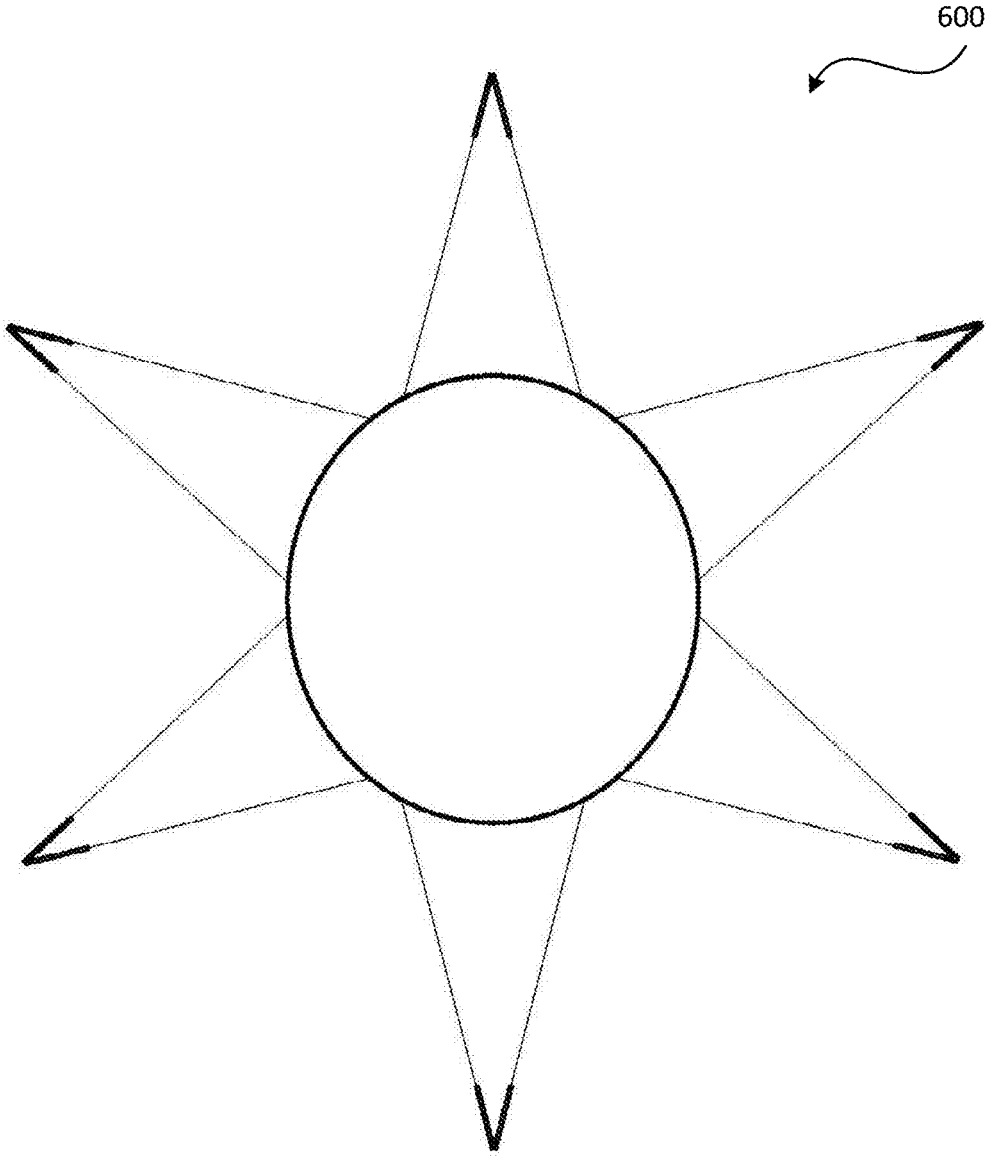
FIG. 6 is an illustration 600 showing the hat umbrella mechanism in an expanded state.

FIG. 5 is an illustration 500 of the frame 200 with the radial supports 206 retracted. The rib 208 is preferably made from thin and narrow plastic or metal that is slightly curved. The rib is curved toward the center of the frame 200. When the radial support 206 is extended, two ribs forms two sides of an isosceles triangle and the frame 200 forms a FIG. 600 shown in FIG. 6.

Figure 7:
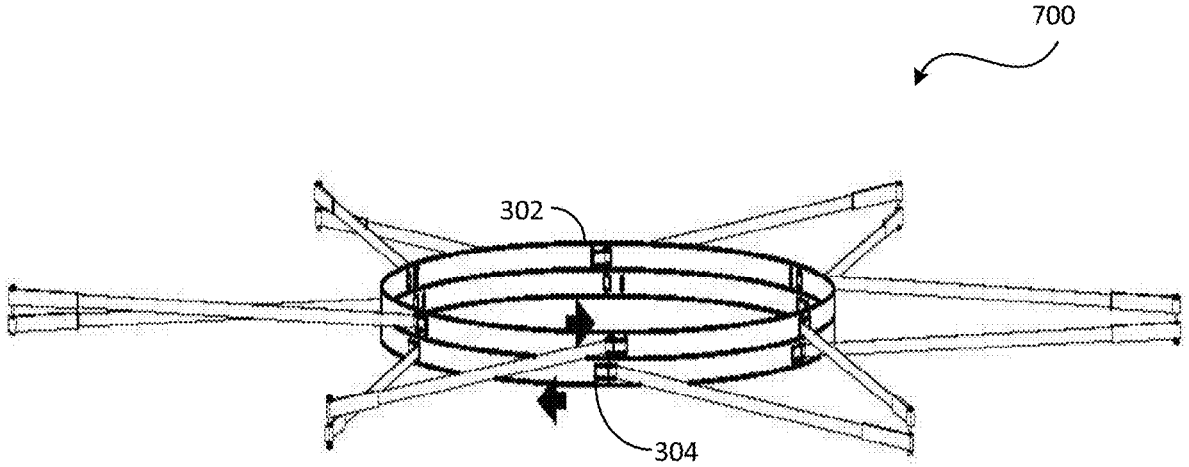
FIG. 7 is yet another illustration 700 showing the mechanism of the hat mechanism.

FIG. 7 is an illustration 700 of the frame 200. The upper circular frame 302 and the lower circular frame 304 rotate in opposite directions as indicated by the arrows shown in FIG. 7. As the upper circular frame 302 and the lower circular frame 304 rotate in opposite directions, two legs of each isosceles triangle slides away from each other, thus retracting the radial support 206. The upper circular frame 302 is mounted on a track above the lower circular frame 304 and the lower circular frame 304 is mounted on the same track but in the inferior part. When the upper circular frame 302 and the lower circular frame 304 rotate toward each other, two legs of each isosceles triangle slides toward each other, thus pushing the radial support 206 away from the circular frame 204.

Figure 8:
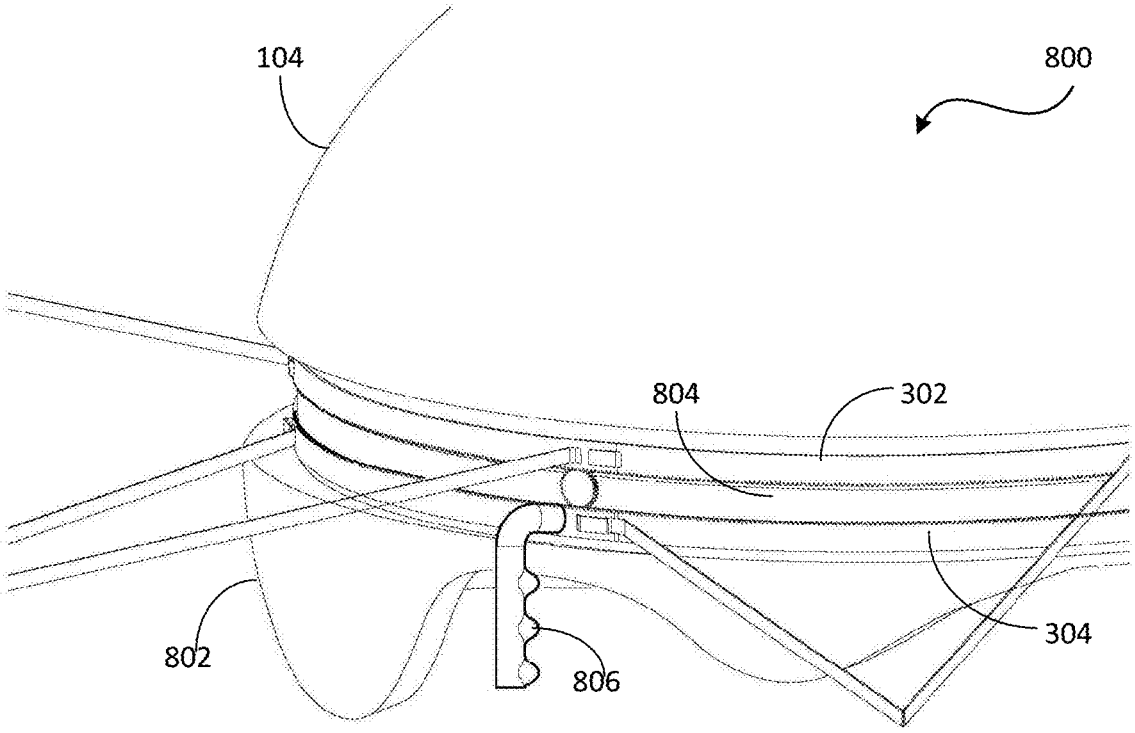
FIG. 8 is yet another illustration 800 showing the hat umbrella mounted on a helmet.

FIG. 8 is an illustration 800 showing more detail of the rotating mechanism of the circular frame 204. The upper circular frame 302 is mounted on top of a track 804 and slides on the track 804. The lower circular frame 304 is mounted under the track 804 and slides under the track 804. In one embodiment, the track 804 may be a circular bearing. The handle 806 is attached to the lower circular frame 304 to assist in rotating the lower circular frame 304. The circular frame 204 is mounted on a helmet 802. The helmet 802 provides a sturdy support for the hat umbrella; however, the head piece 104 is optional. A small electrical motor powered by a battery may be used to rotate the upper circular frame and the lower circular frame.

Figure 9:
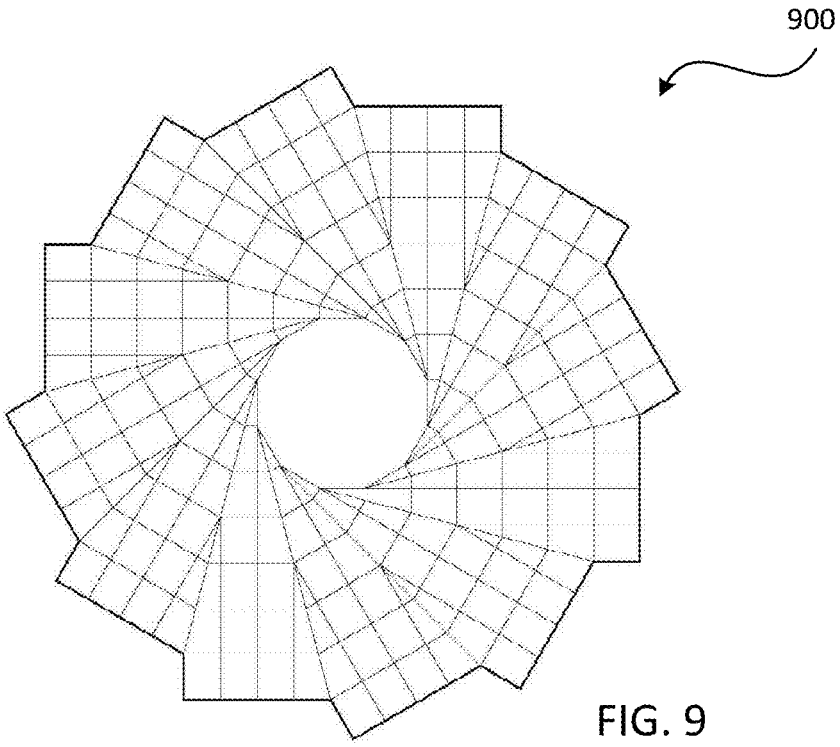
FIG. 9 is an illustration 900 of a cover for the hat umbrella.

FIG. 9 is an illustration 900 of a shade 102 showing a plurality of precut folds that can be attached to the circular frame 204. Shades of different designs can be employed and the shades are attached to the radial supports 206. FIG. 10 is another illustration 1000 showing placement of the radial supports under the shade. The shade can be made from a water proof or water repellant fabric with precut folds designed to collapse onto themselves as shown in FIG. 11. The rotation mechanism twists the fabric to either folding according to the precut folds or expanding into a large shade. The shade can be movably attached to or removed from the radial supports through clips or other attaching devices. So, if a different design of the shade is desired, the old shade can be removed and the new shade attached.

Though the invention is described above using a hat umbrella in FIGS. 1-11 as example, the invention can be easily applied to other hat umbrellas of other shapes.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents. Dimensions in the drawings here presented are not to the scale unless otherwise indicated.

What is claimed is:

1. A hat umbrella, comprising:

an upper circular frame;

a lower circular frame slidably mounted on the upper circular frame; and a plurality of radial supports, each radial support of the plurality of radial supports having a plurality of ribs with a first rib movably attached to the lower circular frame and a second rib movably attached to the upper circular frame, wherein when the first rib and the second rib of a radial support move away from each other, the radial support retracts toward the upper circular frame, and when the first rib and the second rib of the radial support move toward each other, the radial support expand away from the upper circular frame.

2. The hat umbrella of claim 1, further comprising a connecting pin movably securing the first rib and the second rib of a radial support.

3. The hat umbrella of claim 1, wherein each rib is curved toward the upper circular frame.

4. The hat umbrella of claim 1, further comprising a removable shade attached to the plurality of radial supports.

5. The hat umbrella of claim 4, wherein the removable shade has a plurality of precut folds.

6. The hat umbrella of claim 1, further comprising a head piece attached to the upper circular frame.

7. The hat umbrella of claim 1, further comprising a helmet, wherein the upper circular frame and the lower circular frame are attached to the helmet.

8. The hat umbrella of claim 1, further comprising a plurality of swingable hinges, wherein each rib of each radial support is attached to either the upper circular frame or the lower circular frame through a swingable hinge.

9. The hat umbrella of claim 1, further comprising a handle attached to the lower circular frame for rotating the lower circular frame relative to the upper circular frame.

10. The hat umbrella of claim 1, wherein two ribs of a radial support form an isosceles triangle.

11. The hat umbrella of claim 1, further comprising a circular bearing, wherein the upper circular frame is placed on top of the circular bearing and the lower circular frame is placed under the circular bearing.

* * * * *